United States Patent [19]

Tamura et al.

[11] Patent Number: 4,987,424

[45] Date of Patent: Jan. 22, 1991

[54] FILM ANTENNA APPARATUS

[75] Inventors: Kazuhiko Tamura; Atsushi Sato; Yutaka Aizawa, all of Oomiya; Yoshiyuki Suzuki, Ageo, all of Japan

[73] Assignee: Yagi Antenna Co., Ltd., Tokyo, Japan

[21] Appl. No.: 434,573

[22] Filed: Nov. 13, 1989

Related U.S. Application Data

[63] Continuation of Ser. No. 117,536, Nov. 6, 1987, abandoned.

[30] Foreign Application Priority Data

| | | | |
|---|---|---|---|
| Nov. 7, 1986 | [JP] | Japan | 61-171032 |
| Nov. 7, 1986 | [JP] | Japan | 61-171033 |
| Nov. 7, 1986 | [JP] | Japan | 61-171034 |
| Apr. 10, 1987 | [JP] | Japan | 62-088177 |
| Apr. 10, 1987 | [JP] | Japan | 62-088178 |

[51] Int. Cl.[5] ..... H01Q 9/28

[52] U.S. Cl. ..... 343/795; 343/803; 343/806

[58] Field of Search ..... 343/795, 793, 803, 805, 343/806, 720

[56] References Cited

U.S. PATENT DOCUMENTS

| | | | |
|---|---|---|---|
| 1,683,270 | 9/1928 | Taylor et al. | 343/869 |
| 2,821,710 | 1/1958 | Hale | 343/806 |
| 2,875,441 | 2/1959 | McGrane | 343/806 |
| 3,231,894 | 1/1966 | Nagai | 343/806 |
| 3,261,019 | 7/1966 | Lundy | 343/720 |
| 3,587,105 | 6/1971 | Neilson | 343/720 |
| 3,587,110 | 6/1971 | Woodward | 343/813 |
| 3,689,929 | 9/1972 | Moody | 343/806 |
| 3,754,269 | 8/1973 | Clavin et al. | 343/742 |
| 3,780,373 | 12/1973 | Holst et al. | 343/788 |
| 3,815,141 | 6/1974 | Kigler | 343/795 |
| 4,038,662 | 7/1977 | Turner | 343/752 |
| 4,546,357 | 10/1985 | Laughon et al | 343/702 |

OTHER PUBLICATIONS

Sugihara, Patent Abstracts of Japan, vol. 6, No. 254 (E-148) [1132],14th Dec. 1982, JP-A-57 152706.

Oda, Patent Abstracts of Japan, vol. 5, No. 129, (E-70) [801], 19th Aug. 1981; JP-A-56, 65502.

*Primary Examiner*—Rolf Hille

*Assistant Examiner*—Hoanganh Le

*Attorney, Agent, or Firm*—Joseph Scafetta, Jr.

[57] ABSTRACT

An antenna apparatus in which flexible antennas made of a conductive material are formed on a flexible insulating sheet. An insulating film made of a synthetic resin material is used as the insulating sheet, and the antennas are formed by adhering a metal foil on the insulating sheet or by depositing a metal film on the insulating sheet.

2 Claims, 21 Drawing Sheets

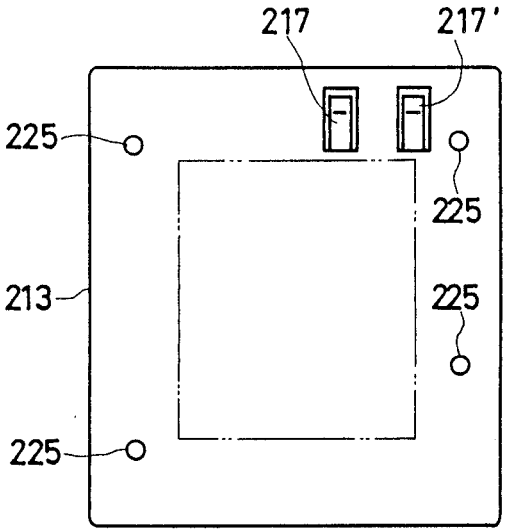
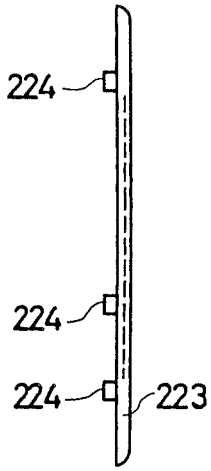
FIG. 11
FIG. 10

FIG. 23
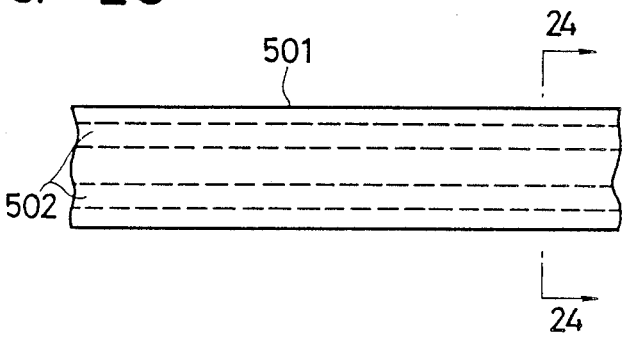
FIG. 24
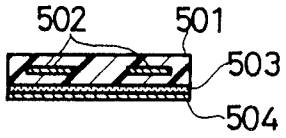
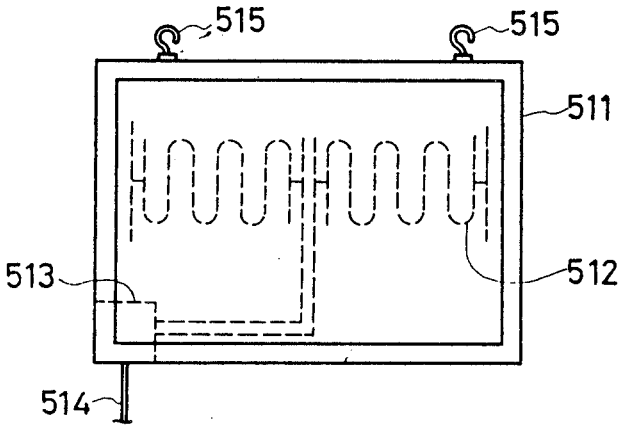
FIG. 25

FILM ANTENNA APPARATUS

This is a continuation of application Ser. No. 07/117,536, filed on Nov. 6, 1987, which was abandoned upon the filing hereof.

BACKGROUND OF THE INVENTION

1. Field of the Invention

The present invention relates to a film antenna apparatus having flexibility and, more particularly, to a thin, light, and flexible antenna apparatus which can be folded in a compact size to be housed and carried, and which can be adhered on or embedded in a surface of a wall or a piece of furniture and hence does not degrade an interior design.

2. Description of the Related Art

In general, as for a VHF/UHF antenna for outdoor use, Yagi-type antennas constituted by metal pipes are widely used. In addition, a variety of antenna apparatuses constituted by metal pipes are used also indoors. However, since shapes and sizes of these antenna apparatuses are limited to obtain necessary characteristics, it is difficult to realize a good design. Moreover, these antenna apparatuses have three-dimensional shapes and hence occupy large spaces as a whole.

Therefore, when an antenna apparatus as described above is adapted especially for indoor use, an interior design is often degraded. Furthermore, such an antenna apparatus is disassembled or folded and then housed in a box or the like to be stored or transported. However, it is troublesome to assemble the apparatus when it is to be used.

In order to eliminate the above drawbacks, plate-like VHF/UHF antenna apparatuses have been developed. One of these antenna apparatuses is disclosed in U.S. Pat. No. 2,821,710 to Hall. This antenna apparatus comprises an antenna component sandwiching an antenna element consisting of metal wires between two electrically insulating plates or sheets. This apparatus can be placed, e.g., behind a picture frame. Since the antenna element of this apparatus cannot be seen from outside, this apparatus does not degrade an interior design. However, since this antenna apparatus cannot be bent or folded, it is inconvenient to store or transport the apparatus.

An antenna apparatus similar to that disclosed in the U.S. patent of Hall is disclosed in U.S. Pat. No. 3,587,105 to Neilson.

In addition, so-called plate-like printed antenna apparatuses each obtained by printing an antenna element on an electrically insulating substrate are disclosed in U.S. Pat. No. 3,587,110 to Woodward and U.S. Pat. No. 3,780,373 to Holst et al. Similar to the above apparatuses, these antenna apparatuses can be incorporated behind a picture or the like.

Moreover, U.S. Pat. No. 3,754,269 to Clavin et al. discloses an omnidirectional antenna apparatus obtained by adhering a band of a flexible conductive material on a flexible electrically insulating material and winding the resultant structure around a radome. However, this antenna apparatus is to be mounted on a large radome and hence is not suitable for receiving TV or FM programs.

SUMMARY OF THE INVENTION

The present invention has been made to eliminate the above drawbacks. It is, therefore, an object of the present invention to provide a film antenna apparatus having flexibility which can be cylindrically rolled up or folded to be housed in a compact space, and hence can be conveniently stored or transported. It is a second object of the present invention to provide a thin and light film antenna apparatus which can be adhered to a wall or a piece of furniture in a room, can be stacked integrally with, e.g., a poster or a calendar, and hence does not degrade a room interior design.

The above objects of the present invention can be achieved by providing an antenna made of a flexible conductive material on a sheet made of a thin flexible electrically insulating material.

According to an embodiment of the present invention, a thin film made of a synthetic resin material or paper is used as the above sheet, and an antenna element such as a thin aluminum foil having flexibility and a predetermined shape is adhered on the surface of the film. According to another embodiment, a conductive material such as aluminum is deposited on the surface of the film. According to still another embodiment of the present invention, cloth or non-woven fabric is used as the above sheet, and conductive thin wires are woven therein or a conductive material is coated or deposited thereon to form an antenna element.

Such an antenna apparatus can be adhered to a wall of a room, or incorporated in furniture or an electric appliance. In addition, such a thin and flexible antenna apparatus can be incorporated in, e.g., a poster, a calendar, or a tapestry. Moreover, the above antenna apparatus is formed to have a cylindrical shape or other three-dimensional shapes, thereby providing both a good design and predetermined characteristics of an antenna.

BRIEF DESCRIPTION OF THE DRAWINGS

The present invention will be apparent from the following description of embodiments taken in conjunction with the drawings, in which:

FIG. 10 is a bottom view of the terminal box of FIG. 8;

FIG. 11 is a side view of the rear plate of FIG. 9;

FIG. 23 is a plan view of a feeder used in an antenna apparatus according to the present invention;

FIG. 24 is a cross sectional view taken along line 24—24 of FIG. 23;

FIG. 25 is a plan view of an antenna apparatus incorporated in a picture frame;

DETAILED DESCRIPTION OF THE PREFERRED EMBODIMENTS

Figure 1:
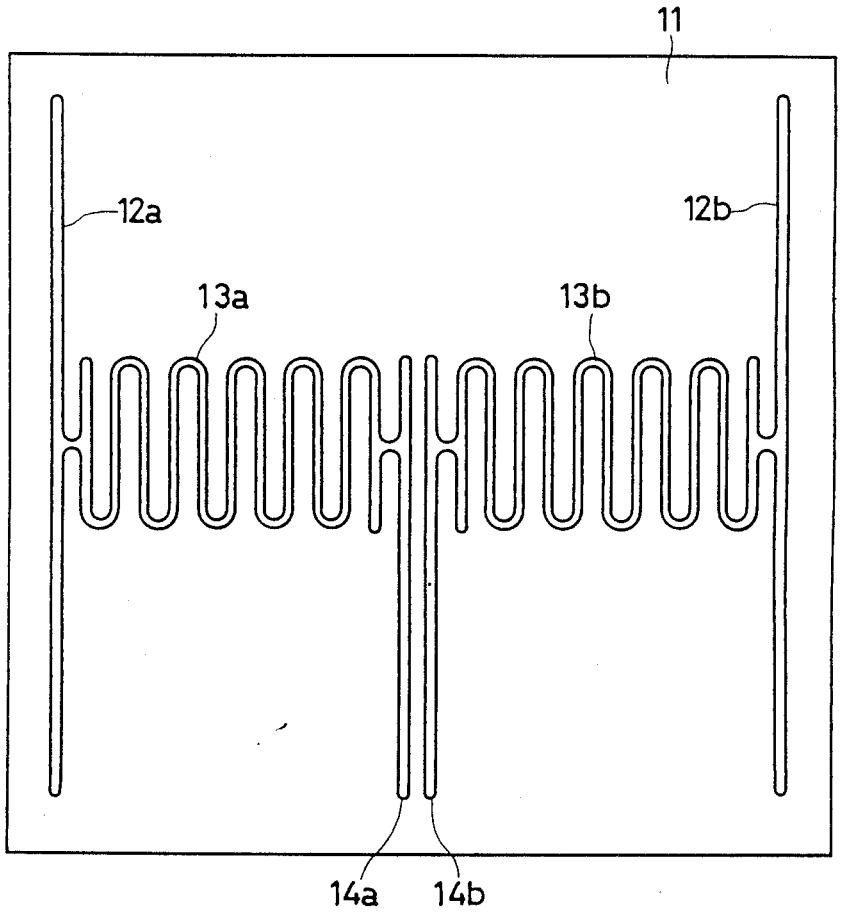
FIG. 1 is a plan view of an antenna apparatus according to an embodiment of the present invention.

Embodiments of the present invention will be described below with reference to the accompanying drawings. FIG. 1 shows an embodiment of a main part of an antenna apparatus according to the present invention. In FIG. 1, there is an electrically insulating sheet 11. In this embodiment, a 0.125 mm thick film formed of a synthetic resin material such as polyester, polyamide, or vinyl chloride is used as the sheet film 11. However, paper, a sheet obtained by stacking paper and a synthetic film, or the like may be used, depending upon applications. Film 11 is thin and flexible and is formed of a transparent material. A pair of antennas 12*a* and 12*b* for receiving, e.g., FM programs, is formed on the surface of film 11. Antennas 12*a* and 12*b* include band-like extension coils 13*a* and 13*b* bent to have a wave shape. Each antenna 12*a* and 12*b* is obtained by cutting out a predetermined shape from a foil formed of a conductive material such as aluminum or copper and is adhered to the surface of the film 11 with an adhesive.

Figure 7:
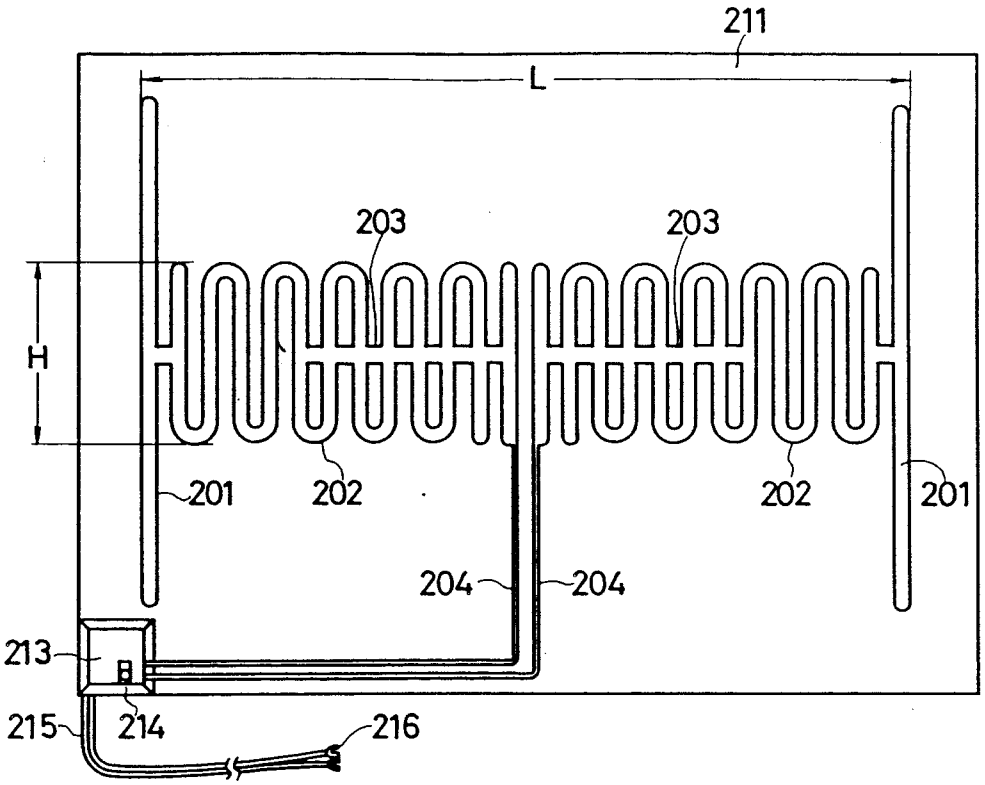
FIG. 7 is a plan view of an antenna apparatus according to still another embodiment.
Figure 8:
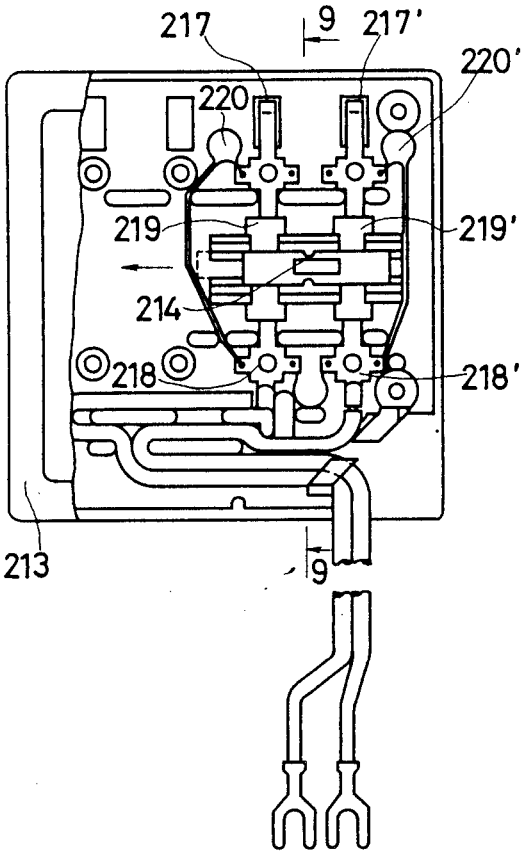
FIG. 8 is a partially cutaway plan view of a terminal box of the embodiment shown in FIG. 7.

The embodiment of the antenna illustrated in FIG. 7 includes a sheet of flexible, insulating material 211 with a dipole antenna on one face thereof, the antenna being formed of conductive foil affixed to the insulating material. The antenna includes two linear antenna elements 201 which extend in spaced, parallel relation to one another; a feeder portion for each of the linear antenna elements, the feeder portions extending in closely spaced, parallel relation to one another midway between the linear antenna elements; and an extension coil 202 for each of the linear antenna elements providing a conductive path between the element and the corresponding feeder portion. As is shown in FIG. 7, each of the extension coils 202 has a wave-like configuration of adjacent crests and troughs with a linear short circuit portion 203 extending from the feeder portion across one or more of the sections of the coil between adjacent crests and troughs. As is discussed in detail hereinafter, the short circuit portion 203, by short-circuiting the base portion of the extension coil 202, provide impedance matching.

Antennas 12*a* and 12*b* may be formed by depositing a conductive material on the film 11 in a predetermined shape by vapor deposition or the like. In this case, prior to vapor deposition, a predetermined masking member may be stacked on the film 11 so that the conductive material is deposited on only a predetermined portion. On the other hand, after the conductive material is deposited on the entire surface of the insulating film 11, unnecessary portions may be removed by etching so that a thin film of material having a predetermined shape remains.

Feeder portions 14*a* and 14*b* extend from end portions of coils 13*a* and 13*b*, respectively. A feeder (not shown) is connected to the distal end portions of feeder portions 14*a* and 14*b* through proper connection terminals. If the above antennas 12*a* and 12*b*, extension coils 13*a* and 13 *b*, and feeder portions 14*a* and 14*b* are formed of a copper material, a feeder may be soldered directly to the distal end portions of feeder portions 14*a* and 14*b*.

The above antenna apparatus can be mounted on a window glass of a vehicle or of a building. In this case, since the film 11 is transparent, a field of vision is not interfered with. Such an antenna apparatus can be adhered to a window glass or a wall using a variety of known adhesives, pressure sensitive adhesives, pins, or other metal fittings.

Figure 2:
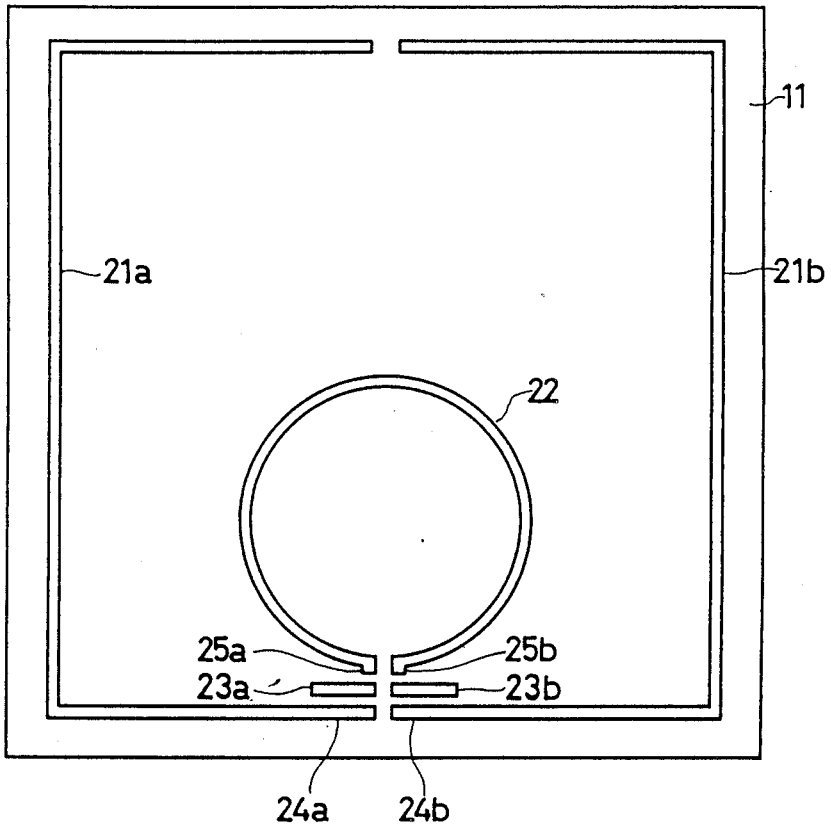
FIG. 2 is a plan view of an antenna apparatus according to another embodiment of the present invention.

FIG. 2 shows another embodiment. This embodiment is an antenna apparatus for receiving TV programs and has an arrangement similar to that of the embodiment shown in FIG. 1 except that a shape of an antenna element of this embodiment corresponds to a frequency band to be received. In the embodiment of FIG. 2, antennas 21*a* and 21*b* for receiving a VHF band, antenna 22 for receiving a UHF band, and auxiliary terminals 23*a* and 23*b* are formed. Antennas 21*a* and 21*b* are bent along an edge portion of substantially square film 11, thereby making the entire antenna apparatus compact. End portions of antennas 21*a* and 21*b* are formed to be feeder portions 24*a* and 24*b*, and end portions of antenna 22 are formed to be feeder portions 25*a* and 25*b*, respectively. Terminal portions 23*a* and 23*b* are used when reception signals from the two antennas (21*a*, 21*b*) and 22 are to be mixed with each other by a pair of feeders (not shown) and extracted.

Figure 3:
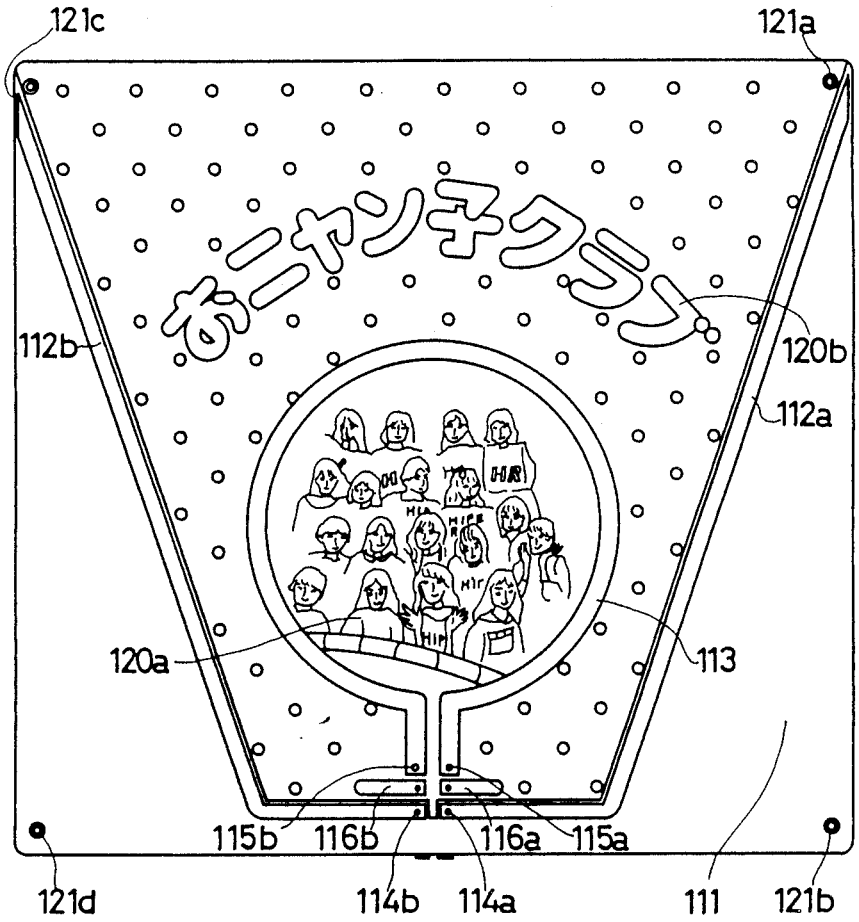
FIG. 3 is a plan view of an embodiment of an antenna apparatus used also as a poster.
Figure 4:
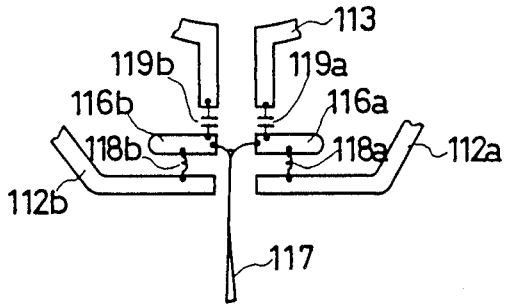
FIG. 4 is a partially enlarged plan view of the embodiment shown in FIG. 3.

FIGS. 3 and 4 show an embodiment in which the antenna apparatus as shown in FIG. 2 is incorporated in a poster. In FIGS. 3 and 4, there is a flexible insulating film 111; 112*a* and 112*b*, antennas for receiving a VHF band; 113, an antenna for receiving a UHF band; and 116*a* and 116*b*, auxiliary terminals. An arrangement of this embodiment is substantially the same as those of the embodiments shown in FIGS. 1 and 2. Feeder portions 114*a* and 114*b* are formed at end portions of antennas 112*a* and 112*b*, and feeder portions 115*b* and 115*b* are formed at end portions of antenna 113, respectively. On film 111, photograph 120*a* of singers is printed inside antenna 113, and patterns and characters 120*b* are printed between antennas 112*a* and 112*b* and antenna 113. Note that band-like antennas 112*a*, 112*b*, and 113 are used as frame lines of portions where the photograph 120a and the patterns 120b are printed. Holes 121a to 121d are formed at corners of film 111, so that the antenna apparatus used also as a poster is adhered to a wall or the like by pins piercing through these holes 121a to 121d. When a VHF signal from antennas 112a and 112b and a UHF signal from antenna 113 are to be mixed with each other and supplied through single signal line 117 as shown in FIG. 4, line 117 is connected to terminals 116a and 116b, coils 118a and 118b are connected between feeder portions of antennas 112a and 112b and terminals 116a and 116b, and capacitors 119a and 119b are connected between feeder portions of antenna 113 and terminals 116a and 116b, thereby forming a mixing circuit.

Photograph 120a and patterns and characters 120b may be printed directly on the surface of film 111, or a transparent film on which the above photograph 120a, characters 120b, and the like are printed at predetermined portions may be stacked on film 111. In the latter case, since the transparent film stacked on film 111 covers the antennas 112a, 112b, and 113, the antennas are effectively protected.

Figure 5:
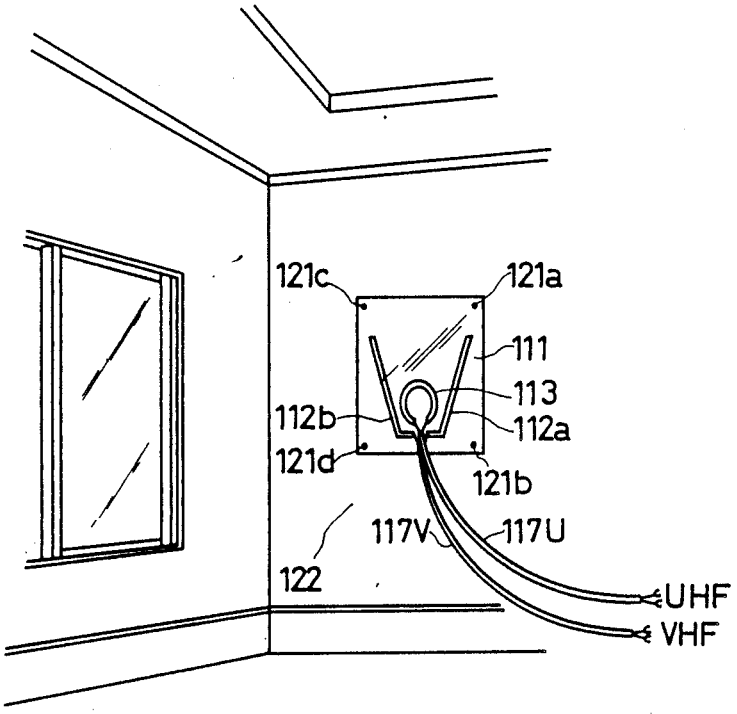
FIG. 5 is a perspective view showing how the antenna apparatus of FIG. 3 is used.

The above antenna apparatus used also as a poster is adhered to a wall of a room as shown in FIG. 5 and is connected to feeders 117V, 117U, and the like. The antenna apparatus according to this embodiment does not degrade a room interior design.

Figure 6:
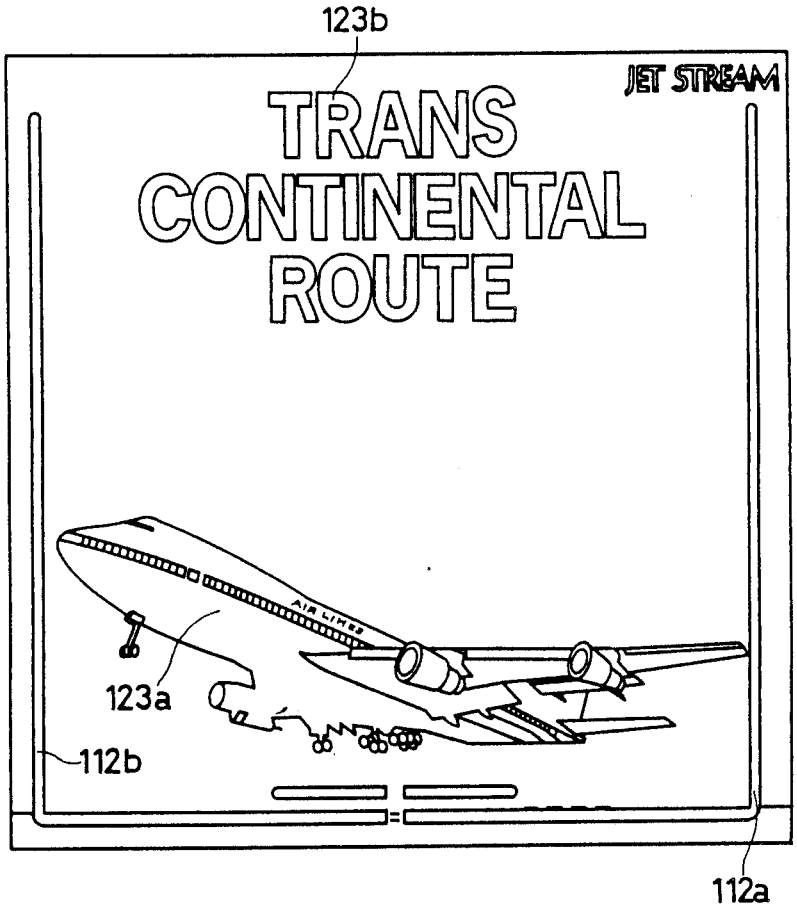
FIG. 6 is a plan view of another embodiment of the antenna apparatus used also as a poster.

FIG. 6 shows an antenna apparatus used also as a poster for receiving only a VHF band. In this apparatus, antennas 112a and 112b for receiving a VHF band are formed to be bent along an edge portion of an insulating film, and photograph 123a, characters 123b, and the like are printed at a central portion of the insulating film. Note that this embodiment has substantially the same arrangement as that shown in FIG. 3. According to this embodiment, since antennas 112a and 112b are arranged along the edge portion of the insulating film and hence are not conspicuous and printing can be arbitrarily performed at the central portion, a poster can be freely designed.

FIGS. 7 to 11 show an embodiment of an antenna apparatus comprising a terminal device. In FIGS. 7 to 11, there is a flexible insulating film 211. Linear antennas 201 and wave-like extension coils 202 both made of a thin-film-like conductive material are formed on film 211. Linear short-circuit portions 203 are formed at base portions of coils 202. Feeder portions 204 are connected to the base portions of coils 202. An arrangement of a main body of this antenna apparatus is substantially the same as that of the antenna apparatus of FIG. 1.

Feeder terminal box 213 is provided at a corner of film 211. The antenna apparatus is connected to feeder 215 through box 213, and feeder 215 is connected to a receiving unit through terminal 216. Switch 214 for switching receiving sensitivity is provided on box 213.

Box 213 is arranged as follows. That is, in FIGS. 8 and 9, there are leaf springs 217 and 217'; 218 and 218', output terminals; and 219 and 219', slide terminals. When switch 214 is moved in the direction of the arrow shown in FIG. 8, slide terminals 219 and 219' are moved together with switch 214 and separated from springs 217 and 217' and output terminals 218 and 218'. Capacitors 220 and 220' are connected between the leaf springs 217 and 217' and the output terminals 218 and 218', respectively. Therefore, when the slide terminals 219 and 219' are in contact with the leaf springs 217 and 217' and the output terminals 218 and 218', the leaf springs 217 and 217' and the output terminals 218 and 218' bypass the capacitors 220 and 220' and hence are short-circuited with each other. On the other hand, when the slide terminals 219 and 219' are moved away from the leaf springs 217 and 217' and the output terminals 218 and 218', the capacitors 220 and 220' are connected in series between the leaf springs 217 and 217' and the output terminals 218 and 218'. Therefore, by operating switch 214, capacitors 220 and 220' can be inserted in or removed from the circuit.

Figure 9:
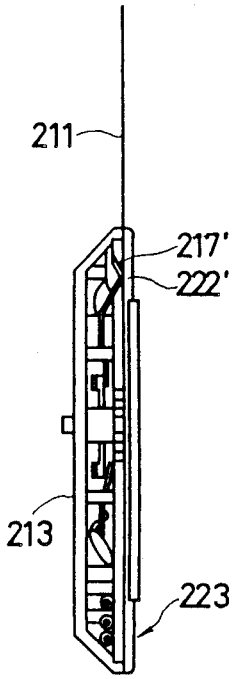
FIG. 9 is a sectional view taken along line 9—9 of FIG. 8.

As shown in FIG. 9, springs 217 and 217' are urged against end portions of feeder portions 204 (FIG. 7). Rear plate 223 is placed behind the terminal box 213 so that film 211 is sandwiched therebetween. Four projections 224 are formed on the rear plate 223 as shown in FIG. 11, and four holes 225 shown in FIG. 10 are formed in box 213 at positions corresponding to the projections 224. Projections 224 of the rear plate 223 extend through the four holes 225 formed at corners of the film 211 and are fitted in holes 225 so that the terminal box 213 and the rear plate 223 are coupled with each other while sandwiching film 211 therebetween.

According to the above embodiment, box 213 is easily mounted at the corner of film 211. Therefore, the feeder 215 (FIG. 7) can be easily connected to the antenna apparatus. In addition, by operating switch 214 provided to the terminal box 213, the characteristics of the antenna apparatus can be varied in correspondence with a frequency band to be received. That is, when switch 214 is operated to separate slide terminals 219 and 219' away from springs 217 and 217' and output terminals 218 and 218', short-circuiting between springs 217 and 217' and output terminals 218 and 218' is eliminated, and capacitors 220 and 220' are connected in series therebetween. Therefore, inductive reactance of the antenna apparatus is cancelled by capacitive reactance of the capacitors 220 and 220', and a resonant frequency of the antenna apparatus transits to a higher frequency. On the other hand, when switch 214 is moved in the opposite direction to short-circuit the leaf springs 217 and 217' and the output terminals 218 and 218' by the slide terminals 219 and 219', the above capacitors 220 and 220' are disconnected, and the resonant frequency of the antenna apparatus transits to a lower frequency. That is, the resonant frequency of the antenna apparatus can be selected in correspondence to a frequency band to be received. Note that in this embodiment, each of capacitors 220 and 220' has a capacitance of about 47 pF.

Moreover, according to this embodiment, since short-circuit portions 203 (FIG. 7) are formed at the base portions, i.e., the feeder-side end portions of coils 202, impedance match with respect to a receiving apparatus can be easily obtained. That is, according to a dipole antenna having extension coils 202 bent to have a wave shape as shown in this embodiment in FIG. 7, total length L can be reduced to make the entire antenna apparatus compact. On the other hand, if width H of coils 202 is increased, radiation resistance at the feeder-side end portions is reduced. As a result, in the characteristics of the antenna apparatus, a frequency locus on the Smith chart is widened to make it difficult to obtain the impedance match with respect to the receiving apparatus. However, according to this embodiment, since the wave-like extension coils 202 are partially short-circuited by linear short-circuit portions 203, these portions 203 equivalently constitute a thick dipole antenna. As a result, over reduction in the radiation resistance can be prevented, and frequency locus on the Smith chart is not widened, thereby providing an antenna apparatus having the characteristic by which the impedance match with respect to the receiving apparatus can be easily obtained. Note that since a current distribution at coils 202 is maximized at the feeder-side end portions, it is effective to form the short-circuit portions 203 at the feeder-side end portions, i.e., the base portions of the extension coils 202.

Figure 12:
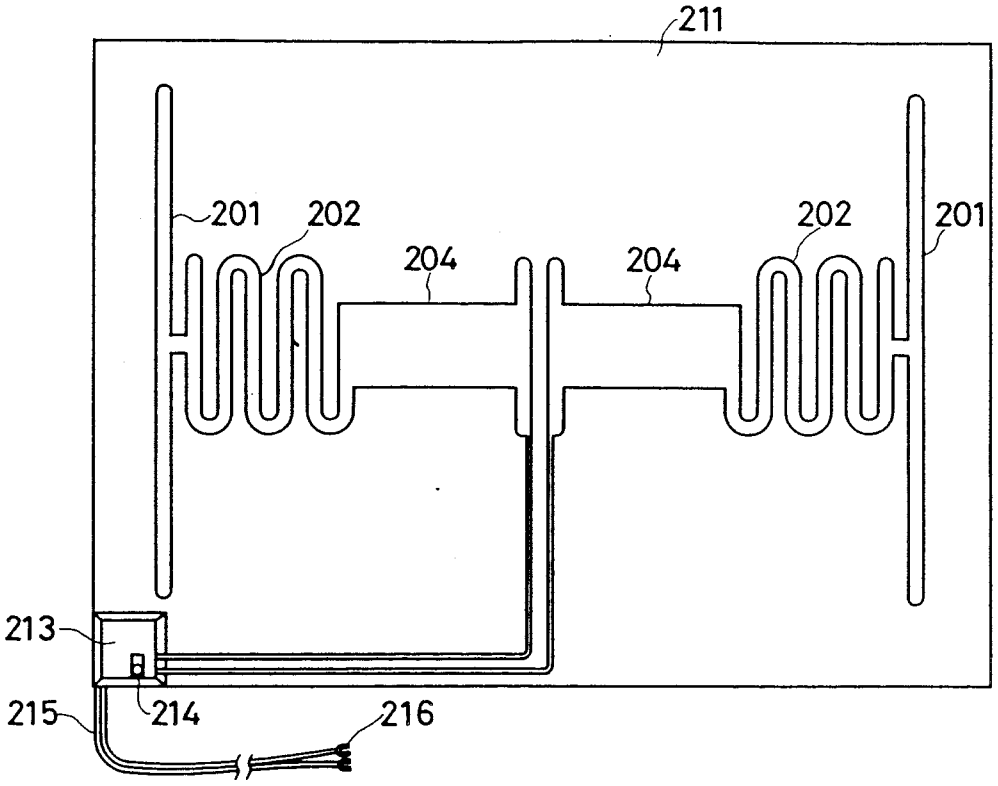
FIG. 12 is a plan view of an antenna apparatus having a short-circuit portion different from that shown in FIG. 7.

FIG. 12 shows another embodiment of the short-circuit portions. In this embodiment, wide band-like short-circuit portions 204 are formed at base portions of extension coils 202. This embodiment can achieve the same effect as that obtained by the embodiment shown in FIG. 7.

Figure 13:
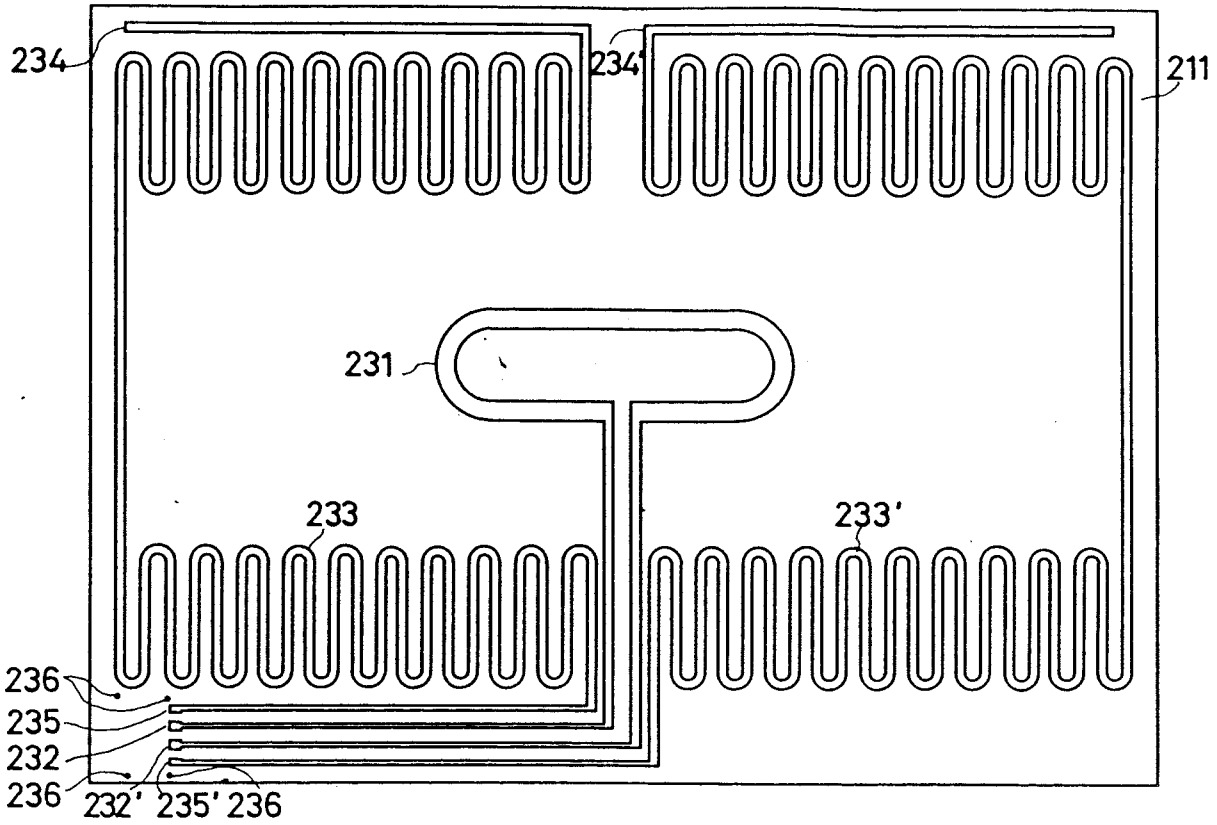
FIG. 13 is a plan view of an antenna apparatus having two types of antennas.
Figures 14, 15:
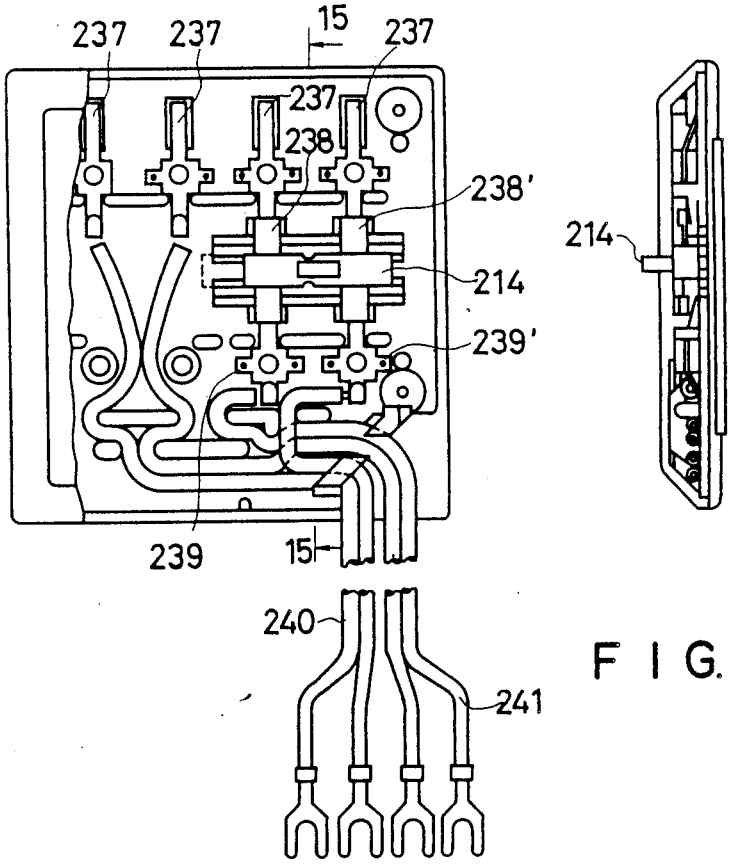
FIG. 14 is a partially cutaway plan view of a terminal box used in the embodiment shown in FIG. 13.
FIG. 15 is a sectional view taken along line 15—15 of FIG. 14.

FIGS. 13 to 15 show an antenna apparatus comprising antennas for receiving both VHF and UHF bands. In this apparatus, antenna 231 for receiving a UHF band and antennas 233 and 233' for receiving a VHF band are formed on insulating film 211. A structure of this antenna apparatus is substantially the same as that of the antenna apparatus shown in FIG. 7. Feeder terminals 232 and 232' are connected to the UHF receiving antenna, and feeder terminals 235 and 235' are connected to the VHF antennas. Four holes 236 are formed at corners of film 211 for mounting a terminal box which is substantially the same as that of the embodiment of FIG. 7. Note that there are portions 234 and 234' for obtaining impedance match. As shown in FIGS. 14 and 15, according to a terminal box used in this embodiment, VHF feeder 240 and UHF feeder 241 are respectively connected to the VHF receiving antennas 223 and 233' (FIG. 13) and the UHF receiving antenna 231 (also FIG. 13). This terminal box comprises leaf springs 237 and 237', slide terminals 238 and 238', and output terminals 239 and 239' and has an arrangement substantially similar to that of the terminal box 213 shown in FIG. 8.

Figure 16:
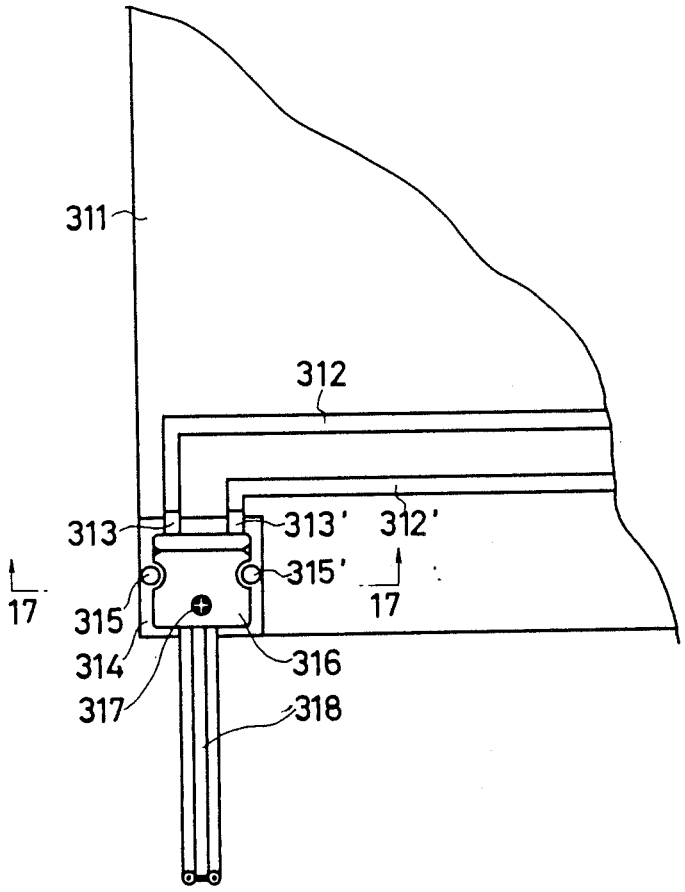
FIG. 16 is a plan view of an embodiment of another terminal box.
Figure 17:
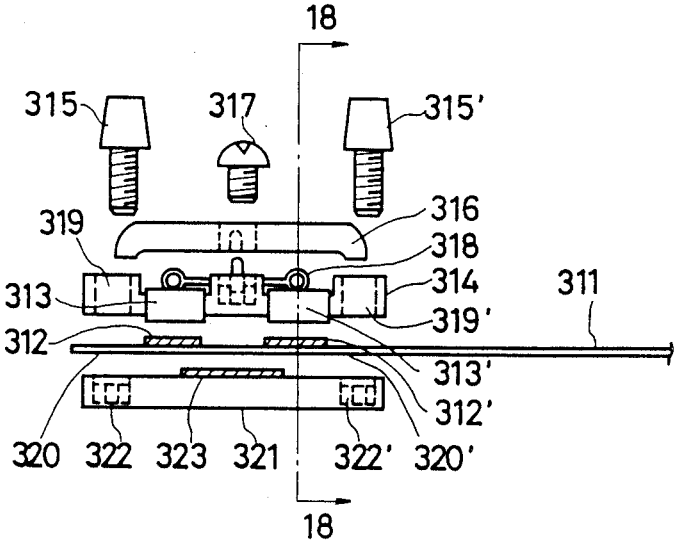
FIG. 17 is an exploded side view of the terminal box of FIG. 16.
Figure 18:
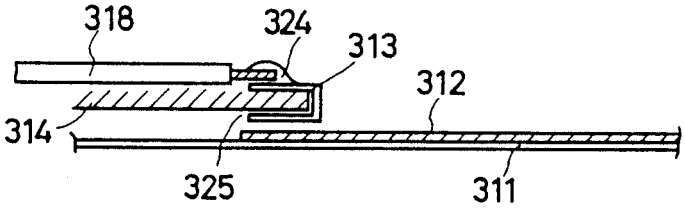
FIG. 18 is a sectional view taken along line 18—18 of FIG. 17.

FIGS. 16 to 18 show another embodiment of the terminal box. An arrangement of this terminal box is suitable for an antenna apparatus in which antennas and feeder portions are formed by printing a conductive paint. That is, such a conductive paint generally contains a silver powder, a carbon powder, or the like and hence is given conductivity by these powders. Therefore, it is difficult to bring the feeder portions formed by coating such a conductive paint into contact with feeder terminal members, often resulting in poor contact.

In FIGS. 16 to 18, there is an insulating film 311. Feeder portions 312 and 312', made by coating a conductive paint including a silver powder, a carbon powder, or the like, are formed on film 311. There are also feeder terminal plates 313 and 313'and a front plate 314. Terminal plates 313 and 313' are mounted to front plate 314. As shown in FIG. 17, the film 311 is sandwiched between a rear plate 321 and the front plate 314. Note that two-side adhesive tape 323 is adhered on the upper surface of rear plate 321 to fix the insulating film 311 to the rear plate 321. Two holes 319 and 319' are formed in front plate 314, and nuts 322 and 322', are provided in rear plate 321. Two bolts 315 and 315' are threadably engaged with nuts 322 and 322' through holes 319 and also through 319'and holes 320 and 320' formed in film 311. By tightening the bolts 315 and 315', film 311 is sandwiched between the front plate 314 and rear plate 321 and fixed therein. Feeder terminal plates 313 and 313' are mounted to front plate 314. Each feeder terminal plate 313 and 313' is U-shaped and fitted on an edge portion of the front plate 314, as shown in FIG. 18. Twin-lead type feeder 318 is connected to ends of terminal plates 313 and 313' by solder 324. Cover 316 in FIG. 17 is provided to cover the soldered portion 324 (FIG. 18) and is mounted on front plate 314 by screw 317. By tightening bolts 315 and 315', other end portions of terminal plates 313 and 313' are urged against feeder portions 312 and 312'. In this embodiment, the feeder terminal plates 313 and 313' are strongly urged against the feeder portions 312 and 312' by the tightening of the bolts 315 and 315' and hence electrically contact therewith is established reliably.

Figure 19:
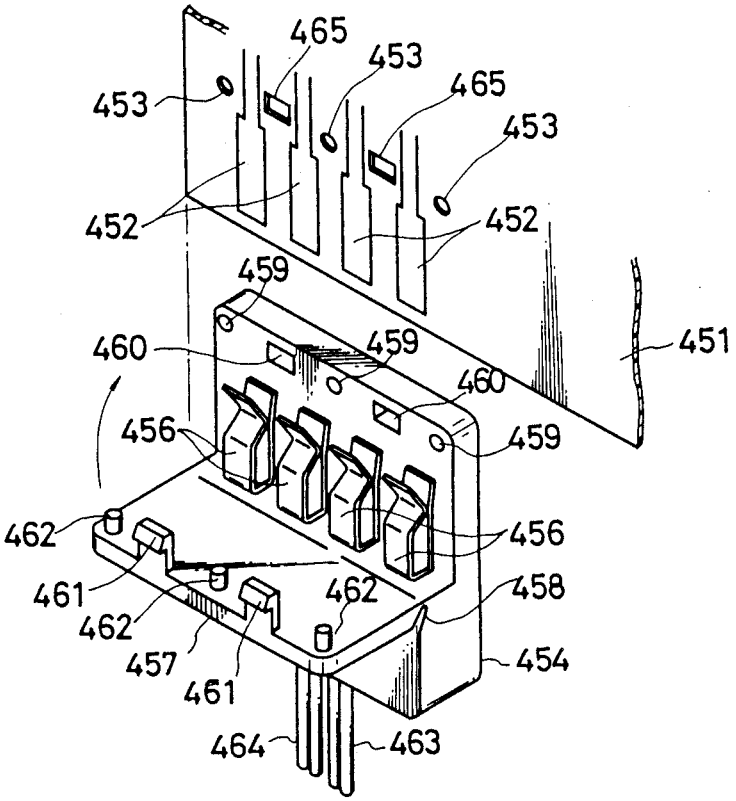
FIG. 19 is an exploded perspective view of an embodiment of another terminal box.

FIG. 19 shows still another embodiment of the feeder terminal box. This terminal box comprises a main body 454 made of, e.g., a synthetic resin. A cover 457 is provided on the main body 454 to be freely opened/closed through a thin portion 458 which serves as a hinge. Elastic U-shaped terminal members 456 are provided on the main body 454 and are connected to a feeder. Fitting holes 460 and positioning holes 459 are formed in an edge portion of body 454. Fitting projections 461 and positioning projections 462 are formed on cover 457 to correspond to fitting holes 460 and positioning holes 459, respectively. Fitting holes 465 and positioning holes 453 are formed in film 451 of the antenna apparatus to correspond to fitting holes 460 and positioning holes 459, respectively. This terminal box is inserted in an end portion of film 451, and terminal members 456 are elastically brought into contact with feeder portions 452 on the insulating film. When cover 457 is pivoted in the direction of the arrow and closed, fitting projections 461 of cover 457 are fitted in fitting holes 460 of body 454 to keep the cover 457 closed. In addition, positioning projections 462 of cover 457 are fitted in positioning holes 453 of the insulating film 451 and in positioning holes 459 of body 454 to fix the terminal box and the insulating film 451 in a predetermined positional relationship. In this case, the feeder terminal members 456 are urged against feeder portions 452 more strongly by the cover 457. This terminal box can be easily attached/detached and hence can be electrically connected to the feeder portions 452 formed on the rear surface of film 451.

Figure 20:
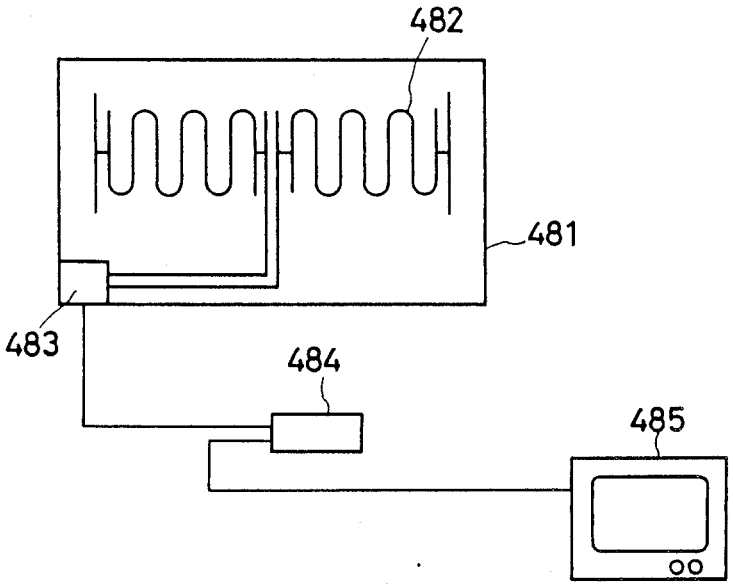
FIG. 20 is a schematic view of an antenna system using an antenna apparatus according to the present invention.

FIG. 20 shows an antenna system using the antenna apparatus of the present invention. In FIG. 20, there is an insulating film 481; 482, an antenna; and 483, a terminal box. A feeder connected to terminal box 483 is connected to a receiving apparatus, e.g., television receiver 485 through switch 484 for switching a plurality of positions (e.g., 15 positions). According to this system, switch 484 is operated to switch an antenna terminal, thereby controlling directivity.

Figure 21:
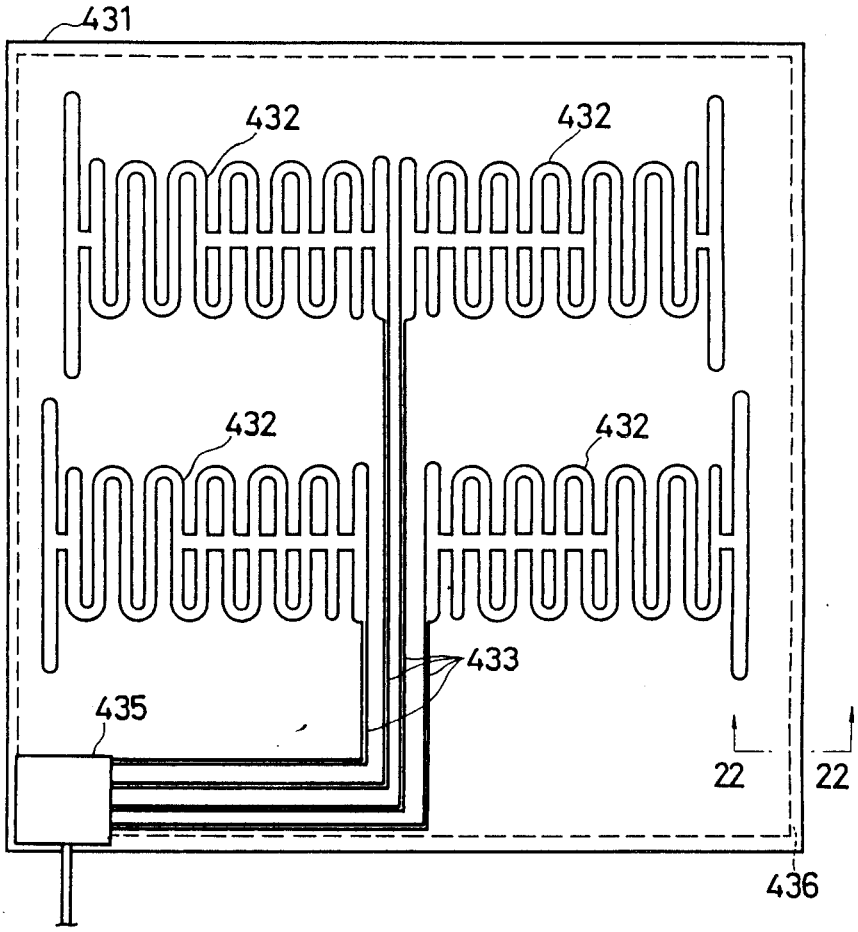
FIG. 21 is a plan view of an antenna apparatus having two antennas.
Figure 22:
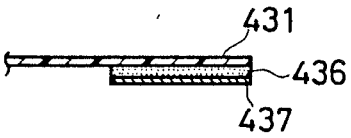
FIG. 22 is a cross sectional view taken along line 22—22 of FIG. 21.

FIGS. 21 and 22 show still another embodiment of an antenna apparatus. In this antenna apparatus, two sets of antennas 432 are formed on film 431 and are connected to a mixer 435 through feeder portions 433. That is, since a signal is received by the two sets of antennas 432, sensitivity is improved. In this embodiment as shown in FIG. 22, two-side adhesive tape 436 is adhered on an edge portion of the rear surface of film 431 and backing paper 437 is adhered thereon. By removing the backing paper 437, this apparatus can be adhered to a wall or the like by tape 436.

FIGS. 23 and 24 show an embodiment of a feeder suitable for an antenna apparatus of the present invention. The antenna apparatus of the present invention is thin, can be adhered on a wall or the like, and hence rarely degrades a room interior design. Therefore, if a conventional feeder is used with this antenna apparatus, a room interior design is degraded because the feeder is conspicuous. A feeder of this embodiment comprises a thin band-like insulating coating 501 made of an elastic synthetic resin or the like. Thin strips of a foil-like conductor 502 made of a metal material are embedded in coating 501. Two-side adhesive tape 503 shown in FIG. 24 is adhered on the rear surface of coating 501, and backing paper 504 is adhered thereon. By removing backing paper 504, the feeder can be adhered directly to a wall or the like by tape 503. In addition, this feeder is thin and hence does not degrade a room interior design. Note that if a transparent material is used as the coating 501, the conductor 502 becomes more conspicuous.

FIG. 25 shows an embodiment in which the antenna of the present invention is incorporated behind a picture frame 511. According to this embodiment, antenna 512 is connected to feeder 514 through terminal box 513 provided on the rear surface of the picture frame 511. Hooks 515 for hanging the picture frame 511 are provided thereto.

Figure 26:
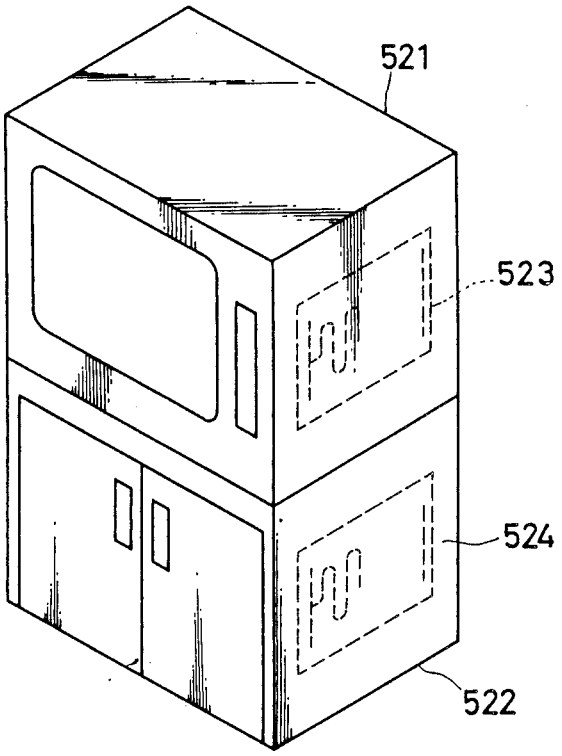
FIG. 26 is a perspective view of an antenna apparatus incorporated in a television set.

FIG. 26 shows an embodiment in which the antenna apparatus of the present invention is incorporated in another furniture product. In FIG. 26, there is a television receiver 521 and a base 522 under the receiver 521. Antenna apparatus 523 according to the present invention is incorporated in part of a cabinet of receiver 521, e.g., a side surface thereof. On the other hand, antenna apparatus 524 according to the present invention may be incorporated in a side surface of base 522. With this arrangement, the antenna apparatus cannot be seen from outside. The antenna apparatus according to the present invention can be similarly incorporated in a variety of furniture products.

Figure 27:
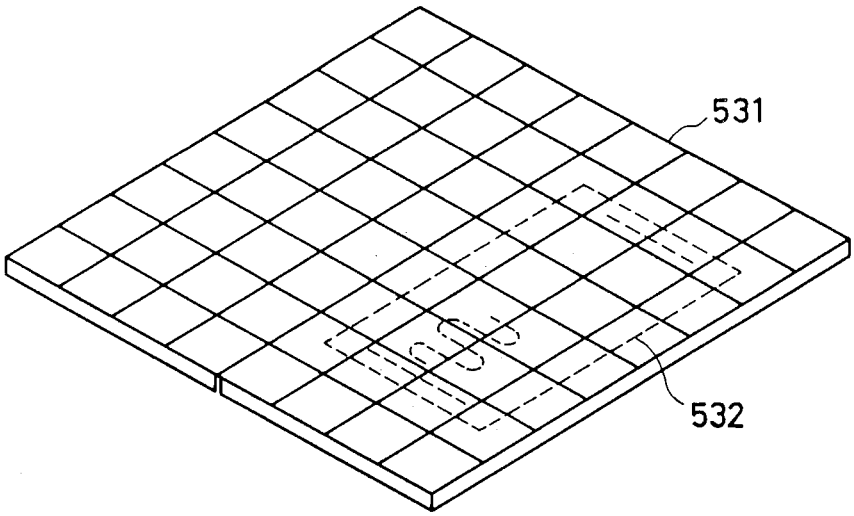
FIG. 27 is a perspective view of an antenna apparatus incorporated in a game board.

FIG. 27 shows an embodiment in which antenna apparatus 532 is incorporated in a game board 531 for chess, Othello, and the like.

Figure 28:
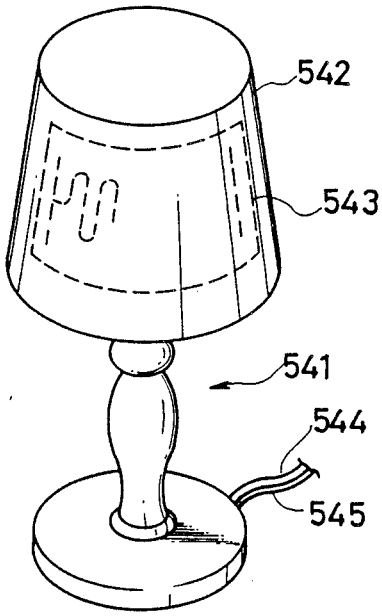
FIG. 28 is a perspective view of an antenna apparatus incorporated in a lamp shade.

FIG. 28 shows an embodiment in which antenna apparatus 543 of the present invention is incorporated in a lamp shade 542 of a desk lamp 541. In this case, feeder 545 to be connected to the antenna apparatus is preferably formed integrally with power source cord 544 of the desk lamp 541.

Figure 29:
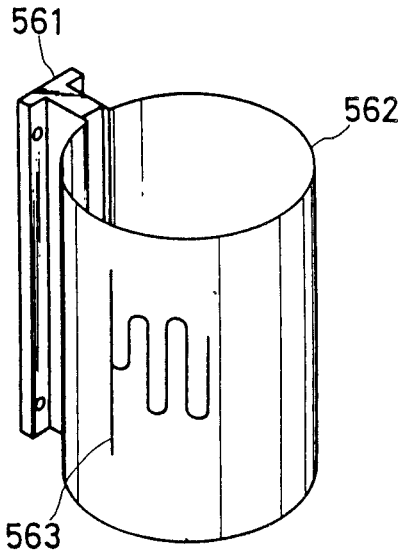
FIG. 29 is a perspective view of an antenna apparatus formed cylindrically.

The antenna apparatus of the present invention can be formed to have a shape other than a flat sheet, e.g., rolled up like a cylinder as shown in FIG. 29 because it is flexible. In FIG. 29, there is an insulating film 562; 563, an antenna; and 561, a mounting portion. This apparatus is mounted on a wall or the like through member 561. Since the antenna apparatus of this embodiment is cylindrical, horizontal omnidirectivity can be obtained. In addition, when a light source is arranged in this antenna apparatus, this antenna apparatus can be used also as an illumination apparatus.

Figure 30:
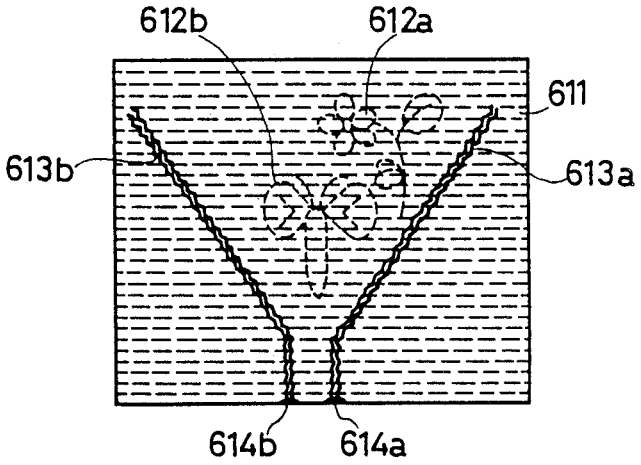
FIG. 30 is a plan view of an antenna apparatus used also as a tapestry.

In the above FIG. 29, the insulating film 562 is an electrically insulating sheet. However, instead of the insulating film 562, cloth or non-woven fabric may be used. FIG. 30 shows one embodiment thereof. In FIG. 30, an insulating sheet 611 is made of cloth or non-woven fabric. Sheet 611 has embroideries **613*a* and 613*b* made of a conductive material and hence can be used as a tapestry. Antennas 613*a* and 613*b* made of a conductive material are formed in sheet 611. Note that there are feeder terminals 614*a* and 614*b* for the antennas 613 and 613*b*. Each antenna portion 613*a* and 613*b* is formed by weaving a conductive string obtained by coating a metal material on a thin metal wire or thin fabric. It is a matter of course that the antenna 613*a* and 613*b*** may be formed by adhering a metal foil or depositing a metal film thereon as described in the previous embodiments.

Figure 31:
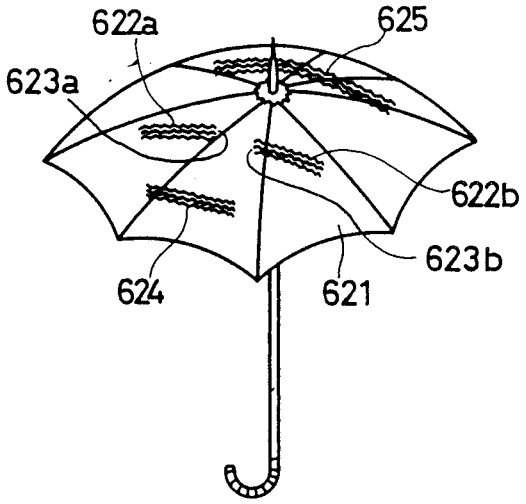
FIG. 31 is a perspective view of an antenna apparatus incorporated in an umbrella.

FIG. 31 shows an embodiment in which the antenna of the present invention is incorporated in an umbrella. In FIG. 31, there is a cloth 621 forming an umbrella, and antennas **622*a*, 622*b*, 624, and 625 are formed in this cloth 612 similar to the embodiment of FIG. 30. In this embodiment, the antenna apparatus constitutes a Yagi-type antenna. That is, antenna 624 constitutes a director, and antenna 625 constitutes a reflector. Note that there are also feeder terminals 623*a* and 623*b***.

It should be understood that the present invention is not limited to the above embodiments but can be variously changed and modified by a person of an ordinary skill in the art without departing from the spirit and scope of the present invention.

What is claimed is:

1. A flat antenna apparatus comprising:

a flexible insulating sheet which can be freely folded; and a flexible antenna made or a conductive foil and formed on said insulating sheet;

said flexible antenna being a dipole antenna having two linear antenna elements extending in spaced, parallel relation to one another on one face of said sheet; a feeder portion for each of said linear antenna elements, said feeder portions extending in closely spaced, parallel relation to one another midway between said linear antenna elements; for each of said linear antenna elements, an extension coil electrically connecting said linear antenna element to the respective one of said feeder portions, each extension coil having a wave-like configuration of adjacent crests and troughs; and a linear short-circuit portion for each of said extension coils extending from the corresponding one of said feeder portions and crossing at least one section of said extension coil between adjacent crests and troughs to directly electrically connect each of said cross sections to said corresponding feeder portion, thereby achieving impedance matching of said antenna apparatus with respect to a receiving apparatus.

2. The flat antenna apparatus of claim 1 further including a feeder terminal for each of said feeder portions and a terminal box detachably secured to said insulating sheet at one edge thereof, said terminal box having terminals which are in electrical contact with said feeder terminals.

* * * * *

UNITED STATES PATENT AND TRADEMARK OFFICE
CERTIFICATE OF CORRECTION

PATENT NO. : 4,987,424

DATED : January 22, 1991

INVENTOR(S) : Kazuhiko Tamura et al.

It is certified that error appears in the above-identified patent and that said Letters Patent is hereby corrected as shown below:

Cover page, left column, Section [30], Foreign Application Priority Data, line 1, after "61-171032", insert --U--;

Section [30], line 2, after "61-171033", insert --U--; and

Section [30], line 3, after "61-171034", insert --U--.

Cover page, right column, line 13, after "al", insert --.--;
line 18, delete "," (second occurrence); and Section [57], Abstract, line 2, change "are" to --is--.

Col. 1, line 48, change "patent" to --Pat.--.

Col. 2, line 22, change "non-woven" to --nonwoven--.

Col. 4, line 7, change "provide" to --provides--; and
line 25, change "13 b" to --13b--.

Col. 7, line 32, change "223" to --233--;

line 57, change "two-side" to --two-sided--;

line 60, delete "," (second occurrence); and line 63, delete "also through" and after "and" (first occurrence), insert "also through".

UNITED STATES PATENT AND TRADEMARK OFFICE

CERTIFICATE OF CORRECTION

PATENT NO. : 4,987,424

DATED : January 22, 1991

INVENTOR(S) : Kazuhiko Tamura et al.

It is certified that error appears in the above-identified patent and that said Letters Patent is hereby corrected as shown below:

Col. 8, line 11, change "electrically" to --electric--; and line 59, change "two-side" to --two-sided--.

Col. 9, line 7, change "Two-side" to --Two-sided--; and line 57, change "non-woven" to --nonwoven--.

Col. 10, line 23, delete "an";

line 30, in claim 1, change "or" to --of--.

Signed and Sealed this

Twenty-eighth Day of April, 1992

*Attest:*

HARRY F. MANBECK, JR.

*Attesting Officer*

*Commissioner of Patents and Trademarks*